US006290836B1

(12) United States Patent
Eccles

(10) Patent No.: US 6,290,836 B1
(45) Date of Patent: Sep. 18, 2001

(54) ELECTRODES

(75) Inventor: Christopher Robert Eccles, Colchester (GB)

(73) Assignees: Christopher R. Eccles, Colchester; Christopher J. Davies; Caroline J. Davies, both of Dedham; Robert M. V. Beith, Wall View, all of (GB)

( * ) Notice: Subject to any disclaimer, the term of this patent is extended or adjusted under 35 U.S.C. 154(b) by 0 days.

(21) Appl. No.: 09/355,783

(22) PCT Filed: Jan. 28, 1998

(86) PCT No.: PCT/GB98/00252

§ 371 Date: Sep. 27, 1999

§ 102(e) Date: Sep. 27, 1999

(87) PCT Pub. No.: WO98/33955

PCT Pub. Date: Aug. 6, 1998

(30) Foreign Application Priority Data

Feb. 4, 1997 (GB) ..... 9702253

(51) Int. Cl.[7] ..... C25B 1/02

(52) U.S. Cl. ..... 205/638; 205/636; 205/210; 205/217; 205/218; 205/223; 204/290.01; 204/292; 204/293; 204/278

(58) Field of Search ..... 205/636, 638, 205/210, 217, 218, 223; 204/290.01, 292, 293, 278

(56) References Cited

U.S. PATENT DOCUMENTS

| | | | | |
|---|---|---|---|---|
| 4,171,247 | * | 10/1979 | Harang et al. | 205/210 |
| 4,450,187 | | 5/1984 | Gestaut | 427/125 |
| 4,496,442 | * | 1/1985 | Okazaki et al. | 205/638 |
| 4,584,065 | * | 4/1986 | Divisek et al. | 205/210 |
| 4,969,980 | * | 11/1990 | Yoshioka et al. | 205/210 |
| 5,843,538 | * | 12/1998 | Ehrsam et al. | 427/601 |

FOREIGN PATENT DOCUMENTS

| | | |
|---|---|---|
| 0405559 | 1/1991 | (EP) . |
| 2132742 | 11/1972 | (FR) . |

* cited by examiner

*Primary Examiner*—Bruce F. Bell

(57) ABSTRACT

An electrode (1) having an active surface for contacting an electrolyte. The electrode (1) comprises first and second metallic materials (2, 3) arranged to provide a number of first metallic material to second metallic material interfaces at the active surface. The invention also relates to a method of making such an electrode (1) and to an electrolysis cell provided with such an electrode (1).

22 Claims, 1 Drawing Sheet

ELECTRODES

TECHNICAL FIELD

This invention relates to an electrode and to a method of making such an electrode. The invention also relates to a cell incorporating such an electrode as its cathode and to a method of obtaining release of gaseous products from such a cell.

BACKGROUND ART

During electrolysis, the mass of a substance liberated by the passage of an electric current is strictly determined by Faraday's Laws of Electrochemical Deposition. These laws state that:

1. "The amount of chemical change occasioned by the passage of an electric current is proportional to the quantity of electricity passed"; and
2. "The masses of different substances liberated by a given quantity of electricity are proportional to their chemical equivalent weights."

The chemical equivalent weight of any substance is easily determined and remains a fixed standard for that substance under all conditions of electrolytic action. It is usually quoted in $m.g.C^{-1}$, 1 Coulomb (C) being the quantity of electricity used when a current of one ampere is passed for one second.

If the chemical equivalent weight is represented by z, the mass, m, of any substance liberated during an electrolytic process is given by:

$$m=z.I.t \tag{1}$$

where I is the current passed in amperes and t is the time in seconds.

During normal electrolytic processes, it is not possible to induce a current to flow through the electrolyte unless the voltage across the electrodes of the electrolytic cell is raised to some specific value, which varies according to the electrolyte and the electrode composition. This voltage, $V_d$, is known as the Decomposition Voltage. Hitherto, it has not been possible to arrange for electrolytic cells to function at voltages sufficiently low to enable of very low-power inputs to the cell.

Any process which can be arranged to run in such a way that, when the calorific value of a liberated gas is higher than the power required to run the electrolytic process which liberates that gas, will act as a net provider of energy. The apparent surplus of energy coming, in this instance, from the bond dissociation energies of the ions involved in the process.

An example of the operation of an electrolytic cell will serve to illustrate the above points more clearly.

Let us first consider a cell which liberates hydrogen gas by the electrolysis of water containing a standard electrolyte such as $H_2SO_4$ or $Li_2SO_4$. If such a cell is run such that its terminal voltage is 5 volts and the current being passed through it is 2 amperes, it will require a power source of at least 10 watts, allowing for small losses in wires and contact resistances. The mass, and hence calorific value, of the hydrogen liberated from such a cell will be in accordance with Faraday's Laws and will be proportional to the product of current and time as outlined above. However, the product of current and time is not the same thing as the product of current and voltage, which gave us the power consumption of the cell. In the case of this cell, the power input is given simply by:

$$P_{in}=V\times I$$

where V is the cell voltage and I is the cell current.

To calculate the power output of such a cell, we need to know how much energy is available from a given mass of hydrogen gas when it combines with oxygen during combustion. This figure is 285 $KJ.mol^{-1}$, where 1 KJ (kilojoule) is the energy converted when 1 kilowatt of power is used for a duration of 1 second. Since the chemical equivalent weight of hydrogen is known to be 0.01045 $mgC^{-1}$, it can be calculated, according to (1) above, that the cell will yield a mass, m, of hydrogen gas given by $$m=0.01045\times10^{-3}\times2\ g.s^{-1}$$

$$=2.09\times10^{-5}\ g.s^{-1}$$

1 mol of hydrogen gas, as molecular hydrogen $H_2$, has a mass of 2.016 g. Utilising the energy content of hydrogen as it undergoes combustion, we therefore have an energy yield from the cell of:

$$\frac{2.09\times10^{-5}\times285\times10^{-3}}{2.016}Js^{-1}=2,9546Js^{-1}$$

$$=2.9546W$$

It can be seen, therefore, that this conventional cell only produces just over a quarter as much energy from the full combustion of its hydrogen yield as the electrical energy required to make it run. Such a device is not an efficient converter of energy.

Consider now the performance of the same cell if its current of 2 amperes were to flow using a very much smaller potential of only 0.5 volts. The input power is given by the same equation (2) above, namely:

$$P_{in}=V\times I$$

$$=0.5\times2=1\ W$$

The output power, however, remains the same as in the 5 volt example, it being dependent solely upon the parameters of current and time.

The 0.5 volt cell, therefore, yields a supply of hydrogen gas which is capable of being burned to provide some 2.9 times the electrical energy input to the cell.

In the past it has not been possible to cause electrolysis cells to operate at the small voltages necessary to achieve this kind of "energy multiplier" effect. The natural barrier of the established decomposition voltage always halted the process some way before the over-unity effects of the cell became evident.

DISCLOSURE OF THE INVENTION

The present invention seeks to provide an electrode which when used in an electrolytic cell enables current to pass at a low voltage compared with conventional cells. It is also an aim of the invention to enable the generation of a gaseous product form an electrolyte.

According to one aspect of the present invention an electrode having an active surface for contacting an electrolyte, is characterised in that the electrode comprises first and second metallic materials arranged to provide at least one first metallic material to second metallic material interface at said active surface.

Preferably there are a plurality of such interfaces.

Preferably the first metallic material comprises a substrate e.g. of steel, of the electrode and the second metallic material, e.g. nickel or a matrix of nickel and chromium, is plated over regions of the substrate.

According to another aspect of the present invention there is provided an electrolysis cell for obtaining the release of gaseous products by electrolysis, comprising an electrolyte, an anode and a cathode in the form of an electrode according to said one aspect of the present invention. In use of the cell, the current can be passed in such a way that decomposition occurs at a fraction of the usual required voltage. Typically "energy multiplier" effects of the order of 6:1 are achievable.

Suitably the electrolyte comprises dilute sulphuric acid or an aqueous solution of lithium sulphate monohydrate, nickel sulphate hexahydrate, chromium sulphate or palladous chloride.

According to a still further aspect of the invention there is provided a method of making an electrode according to said one aspect of the invention, comprising plating a substrate of a first metallic material with a second metallic material and removing regions of the plated second metallic material to create said active surface with said plurality of first metallic material to second metallic material interfaces.

According to a yet further aspect of the present invention, a method of obtaining release of gas from an electrolysis cell according to said further aspect of the invention, comprises applying a decomposition voltage of no more than 1 volt, preferably no more than 0.8 volts, e.g. from 0.2 to 0.6 volts, across the anode and cathode of the electrolysis cell.

BRIEF DESCRIPTION OF DRAWINGS

An embodiment of the invention will now be described, by way of example only, with particular reference to the accompanying drawing, in which.

BEST MODE FOR CARRYING OUT THE INVENTION

Figure 1:
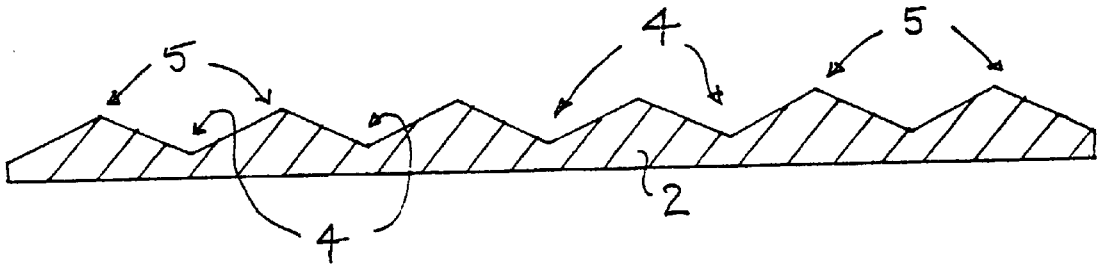
FIGS. 1 to 3 show three stages in the manufacture of an electrode according to the present invention.

A known electrolyte cell comprises an anode and a cathode as electrodes in an aqueous solution of an electrolyte. If a sufficiently large voltage, i.e. the "emf" of the cell, is applied across the electrodes, gaseous products (hydrogen and oxygen) are released at the electrodes. For any given electrolyte in water, this value lie between 1.250 volts and 2.000 volts, depending upon the ambient conditions in the cell (temperature, electrode metals, degree of wetting, pH of the electrolyte etc.), and is known as the Decomposition Voltage or DV. It is made up of three component voltages, which add arithmetically to give the overall DV for the cell, namely: the hydrogen over-voltage at the cathode; the oxygen over-voltage at the anode; and the electrolyte breakdown voltage.

An electrolytic cell in accordance with the invention differs from known electrolytic cells in that it functions as a so-called Sub-Decomposition-Voltage (hereafter referred to as "SDV") cell which is able to operate at voltages well below the predicted emfs which would be expected by summing the three component voltages above for any given set of cell characteristics.

There are two principal parameters of an SDV electrolytic cell which cause it to function in the way it does. The first parameter is the nature of the electrolyte, and the second (more important) is the physical characteristic of the cathodic electrode. These two parameters are considered below.

Electrolyte

In common with nearly all electrolytic mechanisms, an SDV cell will not work using pure water or even, to any great degree, tap water as the electrolyte. The activity of electrolysis depends upon the migration of ions towards charged surfaces, where they act as either donors or recipients of electrons, and there are simply not enough dissociated ions in pure water to enable this to take place effectively. An electrolyte, as well as dissociating into ions itself, will facilitate to a greater or lesser degree the dissociation of the water in which it is placed. The electolyte material is, nonetheless, recycled and wholly conserved in the process and, once charged, an SDV cell, in common with most other electrolysis devices, requires only to be topped up with water, not fresh electrolyte. Examples of electrolytes which have been successfully employed in SDV cells include dilute $H_2SO_4$, lithium sulphate monohydrate, nickel sulphate hexahydrate, chromium sulphate, and palladous chloride, although this is by no means an exhaustive list of the possible substances. Those which function by the release of $SO_4^{2-}$ ions in solution seem also to perform better when acidified slightly.

The Nature of the Cathode

The cathode of the SDV cell has an active surface comprising two different metallic materials with a plurality of interfaces between the different metallic materials. Conveniently the SDV cathode 1 (see FIG. 3) consists of a substrate 2 of a first metallic material and a plurality of isolated plated region 3 on the substrate 2. Suitably the plated second metallic material comprises nickel, or a matrix of nickel and chromium, so as to create interfaces between the substrate and the plating.

At these interfaces in use of the SDV cell, a number of complex electrochemical interactions take place. When a small voltage is applied across the anode and cathode, $H_3O+$ (and other+ve) ions are attracted towards the cathode. These ions are absorbed into the crystal matrix of the nickel plated areas but not into the areas of untreated steel. The sorption process takes place in three main steps, namely: the surface adsorption of the ions, accompanied by their partial dissociation into monatomic hydrogen and water; followed by intergranular rift diffusion of individual atoms of hydrogen between the nickel crystals; and, lastly, lattice diffusion of the same hydrogen atoms from the rifts into the actual lattice of the crystal structure. This is not a clathrate process, there being an immediate association of monatomic H into molecular $H_2$ within the lattice, accompanied by an increase in pressure. The rate-controlling process is probably the surface adsorption as increased working pressure within the cell appears to have little effect on the rate of hydrogen take-up.

Lattice diffusion continues until the interface between nickel and steel is encountered and it is at this point that molecular hydrogen is released into the adjacent electrolyte. The entire process maintains an equilibrium with the ion-product of the water in the electrolyte, new $H_3O+$ and other ions being formed at the same rate as molecular hydrogen is being discharged from the cell. It is thought that there are two catalytic, facilitating, reactions at work. Firstly, the transition from integranular rift diffusion to lattice diffusion is believed to be facilitated by the somewhat unbalanced nature of the two outermost quantum groups in the nickel atom, monatomic hydrogen being "ushered", as it were, by the weak forces within the lattice itself. (Although nascent hydrogen is not itself a polar entity, the existence within any mass of H of two species, ortho- and para-, dependant on Pauli $m_s$ values of + or −½, does not rule out some kind of interaction when such a monatomic gas is confined within an electrostatically active crystalline complex.) Secondly, at the small iron-nickel interfaces which occur when the cathode is machined, there is a degree of electron-sharing between adjacent iron and nickel atoms at the periphery of the crystal structure which in some way mitigates in favour of molecular $H_2$. There are also grounds for considering the existence of free protons within such a intercrystalline confinement and there is nothing in the electrochemistry which would rule this out.

The Anode Process

The anode process differs from that of a conventional cell in that the oxygen over-voltage is rarely exceeded and the reaction at the anode is one of the formation of a (conductive) layer of a matrix of ferrous- and feroso-ferrous-oxide over the plain steel electrode. There is some liberation, albeit slowly, of gaseous oxygen at the anode but this is small in comparison with the ejection of $H_2$ from the cathode, which occurs prolifically and often (as would be expected given the pressure within the crystalline absorption mechanism at work) with some minor violence when observed under the microscope.

There is, obviously, some likely benefit in obtaining hydrogen from such a process which is relatively free of associated oxygen but, to date, the gaseous mix from experimental SDV cells has not been such as to bring the $O_2$ level down below the LEL for hydrogen/oxygen mixture, and such cells should not be regarded as being intrinsically safer than conventional ones.

One method of creating an SDV electrode is described below.

The electrode which is to become the cathode in an SDV cell is made by taking a sheet of ordinary mild steel as the substrate 2 and creating on its surface a series of irregularities, in the form of trough regions 4 and raised regions 5 (see FIG. 1), by etching the steel in a bath of concentrated (50–55%) sulphuric acid. The natural impurity of most commonly available mild steel ensures that etching will take place in a random and irregular manner. Mostly, this is caused by the presence of finely divided granular alpha-ferrite which appears to be preferentially attacked by the acid.

After inspection of the surface and the determination of the average size of the nodes or raised regions on the roughened steel (optimally these should be at 0.03–0.05 mm distribution), the surface is passivated in concentrated nitric acid and further passivated in a chromic acid bath.

Figure 2:
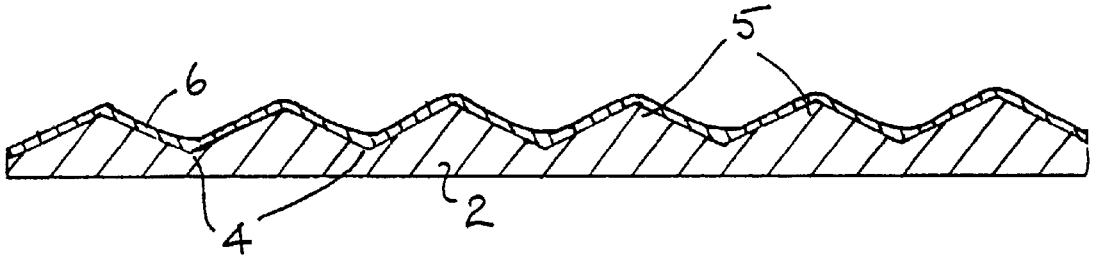

The roughened surface of the steel substrate 2 is then given a 25-micron coating 6 of nickel by the "electroless" process, also known as auto-catalytic chemical deposition (see FIG. 2). This plating process provides accretion of deposited nickel in the trough regions 4 and thinner deposits of nickel on the raised regions 5.

Figure 3:
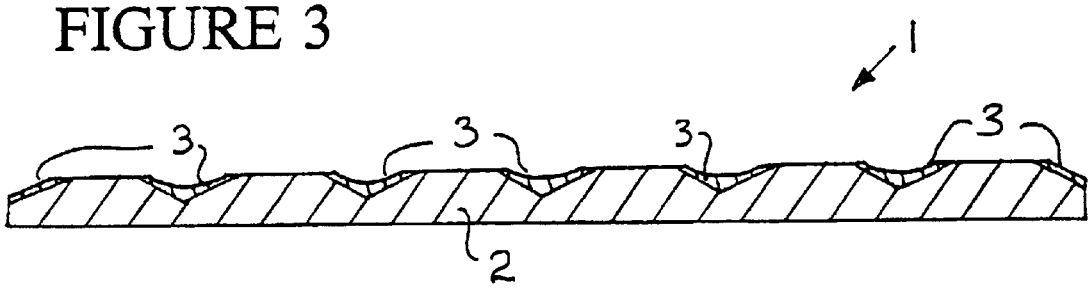

After coating, the electrode is machined or ground, e.g. using a linishing sander and 120 grit silicon carbide paper belt, to remove the "peaks" of the plated raised regions 5 and in particular to remove the plated nickel from these "peaks" so as to expose the steel of the substrate 2 (see FIG. 3). In this way a plurality of metal-to-metal interfaces are created on the active surface of the cathode between the nickel plated regions on the trough regions 4 of the substrate 2 and the exposed steel surfaces of the substrate. Constant microscopic inspection is required to determine the existence of the correct bi-metallic interfaces on the active surface of the electrode. If the electrode is to be used with only one active surface (SAS electrode), no treatment is given to the other plated surface, which will remain electrochemically inactive during the operation of the cell. If both surfaces are required to work electrolytically (DAS), a similar treatment is given to the other side. After cleaning the electrode in methyl ethyl ketone to remove grease and other machining deposits, it is left immersed in a 0.5N aqueous solution of nickel sulphate hexahydrate at 55° C. for 24 hours, which process acts as an "initiator" for the later complex sequence of ion exchange operations in the active cell.

The present invention envisages a novel cathode and SDV electrolytic cell provided with such a cathode. The invention also teaches a novel method of making such a cathode and a novel method of releasing gaseous products from an SDV cell.

The invention discloses the provision of bi-metallic interfaces on the active, electrolyte-contacting surface of an electrode which produces hitherto unobserved electrochemical phenomena. The use of dissimilar metallic materials on the active surface facilitates lattice diffusion of gases within the crystal structure of the electrode.

An SDV cell according to the invention acts as an "over-unity" cell in respect of hydrogen gas production from the cell. The cell operates at low voltages of no more than 1 volt, preferably no more than 0.8 volt and typically from 0.2 to 0.6 volts. However even lower operating voltages are feasible.

What is claimed is:

1. An electrode having an active surface for contacting and electrolyte comprising first and second metallic materials arranged to provide a plurality of first metallic material to second metallic material interfaces at said active surface, wherein said first metallic material comprises steel and said second metallic material comprises nickel.

2. An electrode according to claim 1, wherein said first metallic material comprises a substrate of the electrode and said second metallic material is an electroplated layer over regions of the substrate.

3. An electrode According to claim 2, wherein said substrate has an uneven surface with exposed, unplated raised portions and trough portions plated with said second metallic material, the unplated raised portions and plated second metallic material providing the said active surface.

4. An electrode according to claim 3, wherein the said raised portions of the substrate have an average spacing distribution of from 0.03 mm to 0.05 mm.

5. An electrode according to claim 1, wherein said first metallic material comprises mild steel.

6. An electrode according to claim 1, wherein said second metallic material comprises a matrix of nickel and chromium.

7. An electrode according to claim 1, wherein the electrode is generally flat and has an active surface on each of its opposite sides.

8. An electrolysis cell for obtaining the release of gaseous products by electrolysis, comprising an electrolyte, an anode and a cathode in the form of an electrode according to claim 1.

9. A cell according to claim 8, wherein the electrolyte comprises dilute sulphuric acid.

10. A cell according to claim 8, wherein the electrolyte comprises lithium sulphate monohydrate, nickel sulphate hexahydrate, chromium sulphate or palladous chloride.

11. A method of obtaining release of gas from an electrolysis cell according to claim 8, comprising applying a decomposition voltage of no more than 1 volt across the anode and cathode of the electrolysis cell.

12. The method of claim 11, wherein the step of applying the decomposition voltage comprises applying a decomposition voltage of no more than 0.8 volts.

13. The method of claim 11, wherein the step of applying the decomposition voltage comprises applying a decomposition voltage between the values of 0.2 to 0.6 volts.

14. A method of making an electrode having an active surface for contacting an electrolyte, comprising plating a substrate of a first metallic material with a second metallic material, wherein the first metallic material comprises steel and the second metallic material comprises nickel and in that regions of the plated second metallic material are removed to create said active surface with a plurality of first metallic material to second metallic material interfaces.

15. A method according to claim 14, wherein the surface or surfaces of the substrate onto which the second metallic material is plated is or are made uneven to create raised portions and trough portions onto which the second metallic material is plated.

16. The method according to claim 15, wherein the surface or surfaces of the substrate is or are made uneven by etching.

17. A method according to claim 14, wherein the said regions of plated metallic material are removed by machining.

18. A method according to claim 17, wherein the regions of plated metallic material are machined from said plated raised portions of the substrate.

19. A method according to claim 14, wherein said first metallic material comprises mild steel.

20. A method according to claim 14, wherein said second metallic material comprises a matrix of nickel and chromium.

21. An electrode having an active surface for contacting an electrolyte comprising first and second metallic materials arranged to provide a plurality of first metallic material to second metallic material interfaces at said active surface, wherein said first metallic material comprises steel.

22. An electrode having an active surface for contacting an electrolyte comprising first and second metallic materials arranged to provide a plurality of first metallic material to second metallic material interfaces at said active surface, wherein said second metallic material comprises nickel.

* * * * *